US005615660A

United States Patent [19]

Iwano et al.

[11] Patent Number: 5,615,660

[45] Date of Patent: Apr. 1, 1997

[54] ENGINE AIR-FUEL RATIO CONTROLLER

[75] Inventors: Hiroshi Iwano, Yososuka; Hiraku Ohba, Tokyo, both of Japan

[73] Assignee: Nissan Motor Co., Ltd., Kanagawa, Japan

[21] Appl. No.: 610,923

[22] Filed: Mar. 5, 1996

[30] Foreign Application Priority Data

Mar. 15, 1995 [JP] Japan ..... 7-055890

[51] Int. Cl.[6] ..... F02D 41/00

[52] U.S. Cl. ..... 123/680

[58] Field of Search ..... 123/680, 575, 123/576, 577, 675, 574, 480, 486, 492, 493, 695

[56] References Cited

U.S. PATENT DOCUMENTS

| | | | |
|---|---|---|---|
| 4,509,489 | 4/1985 | Hasegawa et al. | 123/680 |
| 4,682,293 | 7/1987 | Goldenberg et al. | 364/431.05 |
| 4,694,811 | 9/1987 | Bennett | 123/527 |
| 5,014,670 | 5/1991 | Mitsumoto | 123/425 |
| 5,220,904 | 6/1993 | Miyashita et al. | 123/680 |
| 5,253,630 | 10/1993 | Akazaki et al. | 123/682 |
| 5,265,581 | 11/1993 | Nagaishi | 123/675 |
| 5,558,075 | 9/1996 | Maki et al. | 123/680 |

FOREIGN PATENT DOCUMENTS

| | | | |
|---|---|---|---|
| 62-159741 | 7/1987 | Japan | 123/680 |
| 3-26841 | 2/1991 | Japan | 123/680 |
| 3-61644 | 3/1991 | Japan | 123/680 |

*Primary Examiner*—Raymond A. Nelli
*Attorney, Agent, or Firm*—Lowe, Price, LeBlanc & Becker

[57] ABSTRACT

A warmup fuel amount corresponding to a predetermined heavy fuel is set to control an air-fuel ratio of an air-fuel mixture supplied to an engine during warmup. A correction amount based on a difference between a post-warmup engine speed variation and a first reference value is stored, and a warmup fuel amount decreased by this correction is supplied to the engine on the next startup occasion. In this way the sensitivity of air-fuel ratio control during startup when fuels of different nature are used, is enhanced.

6 Claims, 12 Drawing Sheets

ENGINE AIR-FUEL RATIO CONTROLLER

FIELD OF THE INVENTION

This invention relates to a control of fuel injection amount during start-up of an type engine.

BACKGROUND OF THE INVENTION

In fuel injection type engines, engine speed is usually stabilized by increasing a basic fuel injection amount during warmup period immediately following startup in which speed is generally unstable.

However, as the correction coefficient is set for a fuel type having predetermined properties, it may not be suitable when a different fuel type is used, and this adversely affects drivability and exhaust gas emissions.

Tokkai Hei 3-61644 published by the Japanese Patent Office in 1991 proposes that the correction coefficient should be increased based on the engine speed. This method concerns the decline of engine speed during warm-up which occurs when fuel having a high evaporation temperature is used. Specifically, a correction coefficient is set based on standard type fuel, and when the difference between a current engine speed and target engine speed exceeds a predetermined limit, another correction coefficient is applied to increase the fuel mount.

Tokkai Hei 3-26841 published by the Japanese Patent Office in the same year discloses how it is determined whether a fuel is lighter or heavier than a standard fuel type based on a variation of engine speed a predetermined time after start-up, and corrects a fuel injection amount based on the determination result.

However in all of these methods, as the properties of the fuel are determined from the variation of engine speed each time the engine starts, some time is required until the result of the determination is known. Consequently, although the actual properties of the fuel may be different from the initial setting, an air-fuel ratio based on the initial setting is applied until this results is known, and the vehicle is therefore driven with an air-fuel ratio unsuited to the fuel type during this period. A suitable air-fuel ratio is applied only during the short time period from when the fuel injection amount is corrected based on the determination result until warm-up is completed.

Further, a transient correction applied to acceleration and deceleration during warm-up is also set for a standard fuel type. A transient correction unsuited to the fuel used is therefore applied to acceleration and deceleration before the fuel type has been determined.

In view of the above, if drivability of the vehicle is a primary consideration, it is desirable to set the post-warmup correction coefficient and the transient correction coefficient for the heaviest fuel that might be encountered. In this case however, if the fuel is light, fuel will be oversupplied, exhaust gas emissions will be worse and fuel consumption will increase until the air-fuel ratio has been corrected based on the actual fuel type used.

SUMMARY OF THE INVENTION

It is therefore an object of this invention to apply a correction during start-up suited to actual fuel type at an earlier stage.

It is a further object of this invention to apply a transient correction suited to actual fuel type at an earlier stage.

In order to achieve the above objects, this invention provides a device for controlling a air-fuel ratio of an air-fuel mixture supplied to an engine during warmup. The device comprises a mechanism for initializing a warmup fuel amount corresponding to a predetermined heavy fuel, a mechanism for detecting an engine speed variation, a mechanism for determining whether or not the warmup has been completed, a mechanism for computing a difference between a post-warmup engine speed variation and a first reference value as a post-warmup stability tolerance factor, a mechanism for computing a stability indicator learning value based on the post-warmup stability tolerance factor, a mechanism for storing the learning value after the engine has stopped, a mechanism for decreasing the warmup fuel amount to a decreased warmup amount based on the learning value when the engine is restarted, and a mechanism for supplying the decreased warmup fuel mount to the engine.

It is preferable that the learning value computing mechanism comprises a mechanism for computing a stability correction coefficient which increases the lighter the fuel based on the stability tolerance factor, and a mechanism for obtaining the learning value by calculating a weighted average of the stability correction coefficient.

It is also preferable that the controller further comprises a mechanism for computing a difference between an engine speed variation before warmup is complete and a second reference value as a pre-warmup stability tolerance factor, and a mechanism for correcting the learning value according to the pre-warmup stability tolerance factor.

It is also preferable that the controller further comprises a mechanism for detecting whether or not the engine is in an idle state, and that the engine speed variation detecting mechanism detects the engine speed variation only in the case when the engine is in the idle state.

In this case, it is further preferable that the controller further comprises a mechanism for detecting the air-fuel ratio, a mechanism for feedback controlling the supply mechanism such that a detected all-fuel ratio approaches a preset target air-fuel ratio, and a mechanism for controlling the supply mechanism such that the air-fuel ratio is slightly leaner than a stoichiometric all-fuel ratio when the feedback control mechanism has performed several feedback control cycles after the engine is detected to be in the idle state, and that the engine speed variation detecting mechanism detects the engine speed variation when the air-fuel ratio is slightly leaner than the stoichiometric air-fuel ratio in the idle state.

It is also preferable that the controller further comprises a mechanism for initializing a transient fuel mount corresponding to a predetermined heavy fuel, a mechanism for decreasing the transient fuel amount to a decreased transient amount based on the stored learning value, and a mechanism for increasing the decreased warmup amount based on the decreased transient amount.

The details as well as other features and advantages of this invention are set forth in the remainder of the specification and are shown in the accompanying drawings.

DESCRIPTION OF THE PREFERRED EMBODIMENTS

Figure 1:
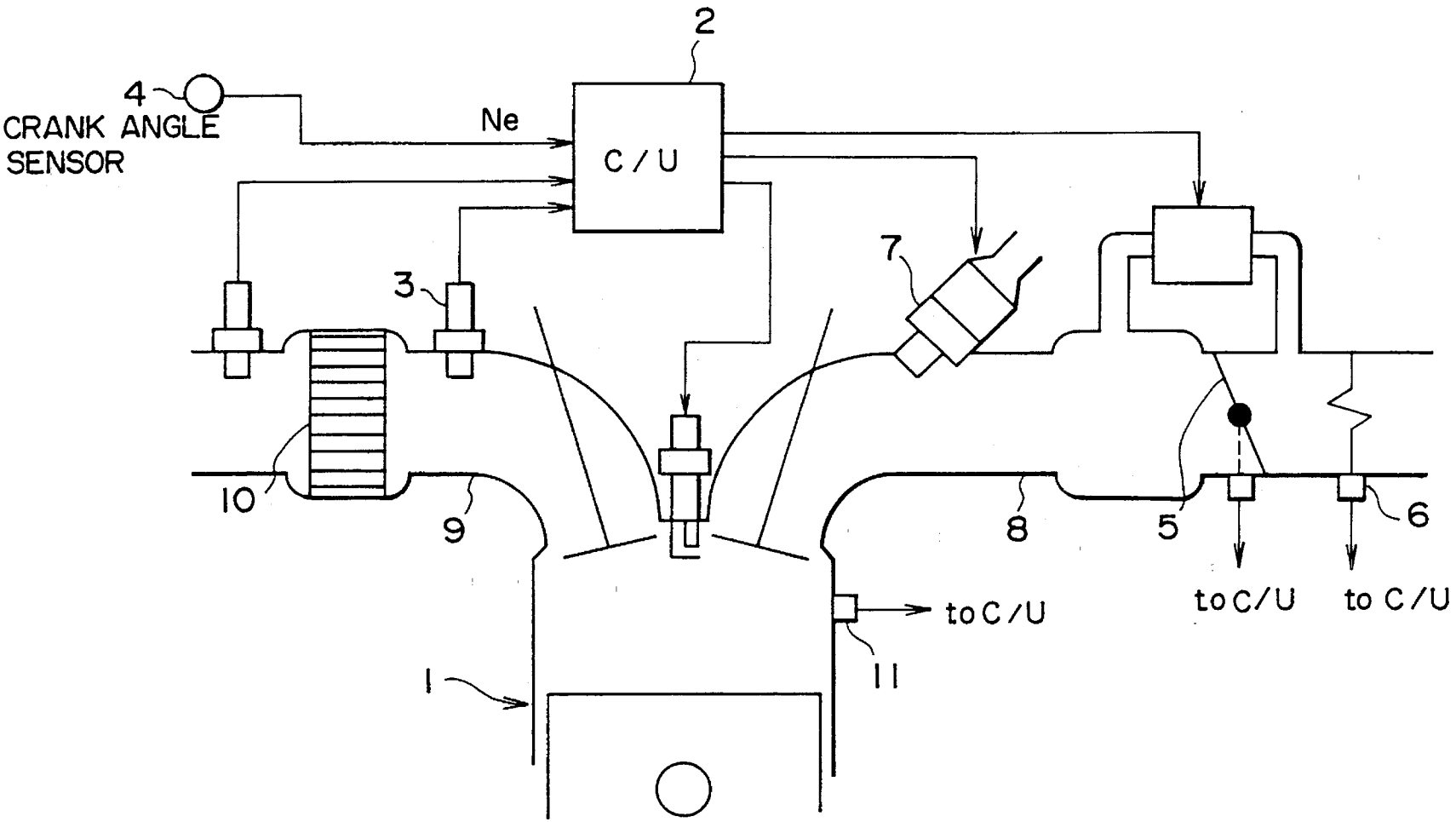
FIG. 1 is a schematic diagram of an air-fuel ratio controller according to this invention.

Referring to FIG. 1 of the drawings, a four-cylinder engine 1 is provided with an intake passage 8 and exhaust passage 9. An air intake throttle 5 is provided in the intake passage 8, and a fuel injection valve 7 is installed downstream of the throttle. A catalyst converter 10 is provided in the exhaust passage.

The fuel injection valve 7 injects fuel into intake air according to an injection pulse signal from a control unit 2.

The control unit 2 for example comprises a CPU, ROM, RAM with backup and an I/O interface.

A Ref signal and Pos signal from a crank angle sensor 4, intake air amount signal from an air flow meter 6, a signal indicating air-fuel ratio or oxygen concentration from an oxygen sensor 3 installed in the exhaust passage 8, and engine cooling water temperature signal from a water temperature sensor 11, are input to the control unit 2.

Based on these signals, during warm-up when the engine is generally unstable, the control unit 2 applies an increased fuel injection mount to drive the engine at an air-fuel ratio richer than the stoichiometric air-fuel ratio during warmup, and performs a transient correction of injected fuel during transient state.

As various types of fuel having different properties and volatilities may be used, priority is given to drivability when the heaviest fuel is used. For this purpose, a post-warmup correction coefficient KAS and water temperature correction coefficient KTW are used to correct the air-fuel ratio. These coefficients are set to initial values applying to the heaviest fuel.

From the engine speed after startup, it is determined whether or not the fuel being used is lighter than the heaviest fuel, and if it is lighter, KAS and KTW for the heaviest fuel are decreased accordingly to suit the lighter fuel.

However if fuel properties are determined from the speed whenever the engine is started up, when light fuel is used, fuel continues to be oversupplied until it is realized that the fuel type is different from that of the initial setting. Moreover, even if KAS and KTW are modified when it is determined that the fuel is light, the vehicle is driven with a suitable air-fuel ratio only for a very short time until warm-up is complete. Still further, when the vehicle accelerates before it has been determined that the fuel is light, an excessive transient correction is applied which makes the air-fuel ratio too rich, or alternatively too lean when the vehicle decelerates.

According to this invention, a warm-up correction coefficient is initialized to suit heavy fuel, but a stability indicator is also detected from the variation of idle rotation speed after warm-up is completed, and a difference between this value and a post-warmup stability limit which is set for the heaviest fuel is calculated as a post-warmup stability tolerance value. A weighting average of a stability correction coefficient depending on the stability tolerance value is then computed as a stability indicator learning value, stored, and a correction coefficient for the next start-up is decreased by this stored learned value.

Similarly, a stability indicator is detected from the idle rotation speed before warm-up is completed, the difference between this value and the permitted stability limit before completion of warm-up which is set for the heaviest fuel is calculated, and a stability tolerance value before completion of warm-up is calculated. A learning value of the stability indicator is then again corrected by a stability correction coefficient depending on this stability tolerance value.

The processing performed by the control unit 2 will now be described using flowcharts.

Figure 2:
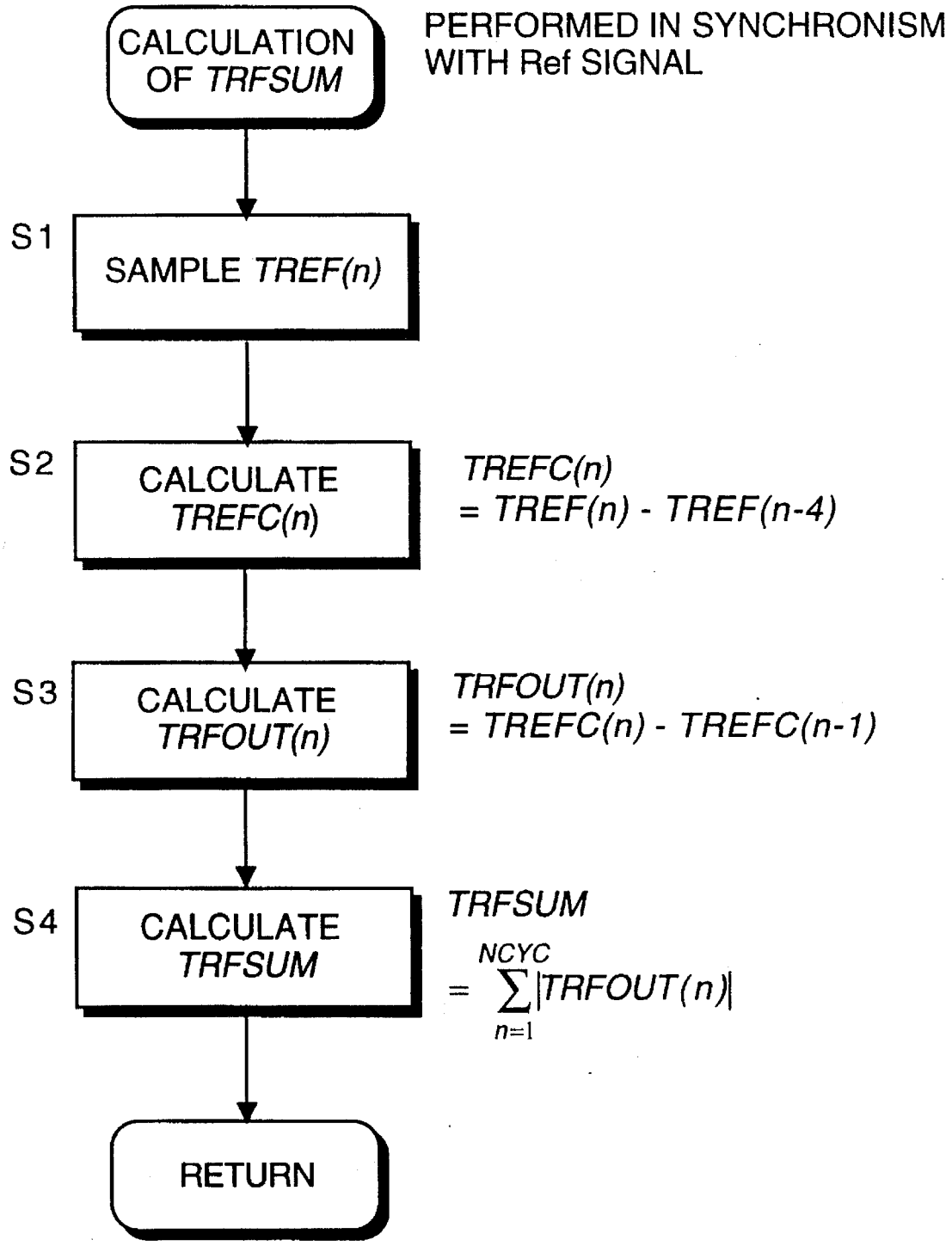
FIG. 2 is a flowchart describing a process for computing an engine stability indicator according to this invention.

FIG. 2 shows a routine for computing engine speed which is performed in synchronism with a Ref signal. The Ref signal is a signal output by the crank angle sensor 4 when the engine crankshaft reaches a predetermined rotation angle, and in the case of a four-cylinder engine it is output each time the crank angle rotates through 180 degrees.

In a step S1, a period TREF(n) of the Ref signal is sampled. n is a sampling frequency. A plurality of values for the period TREF(n) obtained in previous samplings is stored in a RAM. Before sampling, the value of TREF(n) on the immediately preceding occasion is shifted to a predetermined address in the RAM which stored the value of TREF(n) two occasions before, and the value of TREF(n) two occasions before is shifted to a predetermined address which had stored the value of TREF(n) three occasions before.

In a step S2, a variation amount TREFC(n) for each cylinder during the period between Ref signals is calculated by the following equation (1).

$$TRFC(n)=TREF(n)-TREF(n-4) \quad (1)$$

Before performing this calculation, the shift of the old value of TREFC(n) is carried out in the same way as the shift of TREF(n).

The variation TREFC(n) per cylinder is the difference between the current Ref signal period for one cylinder and the Ref signal period for the same cylinder on the immediately preceding occasion combustion occurred in the cylinder, i.e. in a four-cylinder engine, it is the difference between the current Ref signal period and the Ref signal period when combustion occurred four occasions previously. The purpose of calculating the variation for each cylinder is so that the scatter between cylinders will not be interpreted as a variation.

In a step S3, the variation of the variation of the Ref signal period, TRFOUT(n), is calculated by the following equation.

$$TRFOUT(n)=TREFC(n)-TREFC(n-1) \quad (2)$$

TRFOUT(n) is the variation of TREFC from the immediately preceding value of TREFC, and it corresponds to a simulated torque variation due to combustion.

In a step S4, the absolute value of TRFOUT(n) is totaled for a predetermined number of occasions, computed as a stability indicator TRFSUM, and the routine is terminated. The larger a predetermined number of cycles NCYC the higher the detection precision, however as the control speed slows down, an acceptable compromise between these two elements must be determined.

Figure 3:
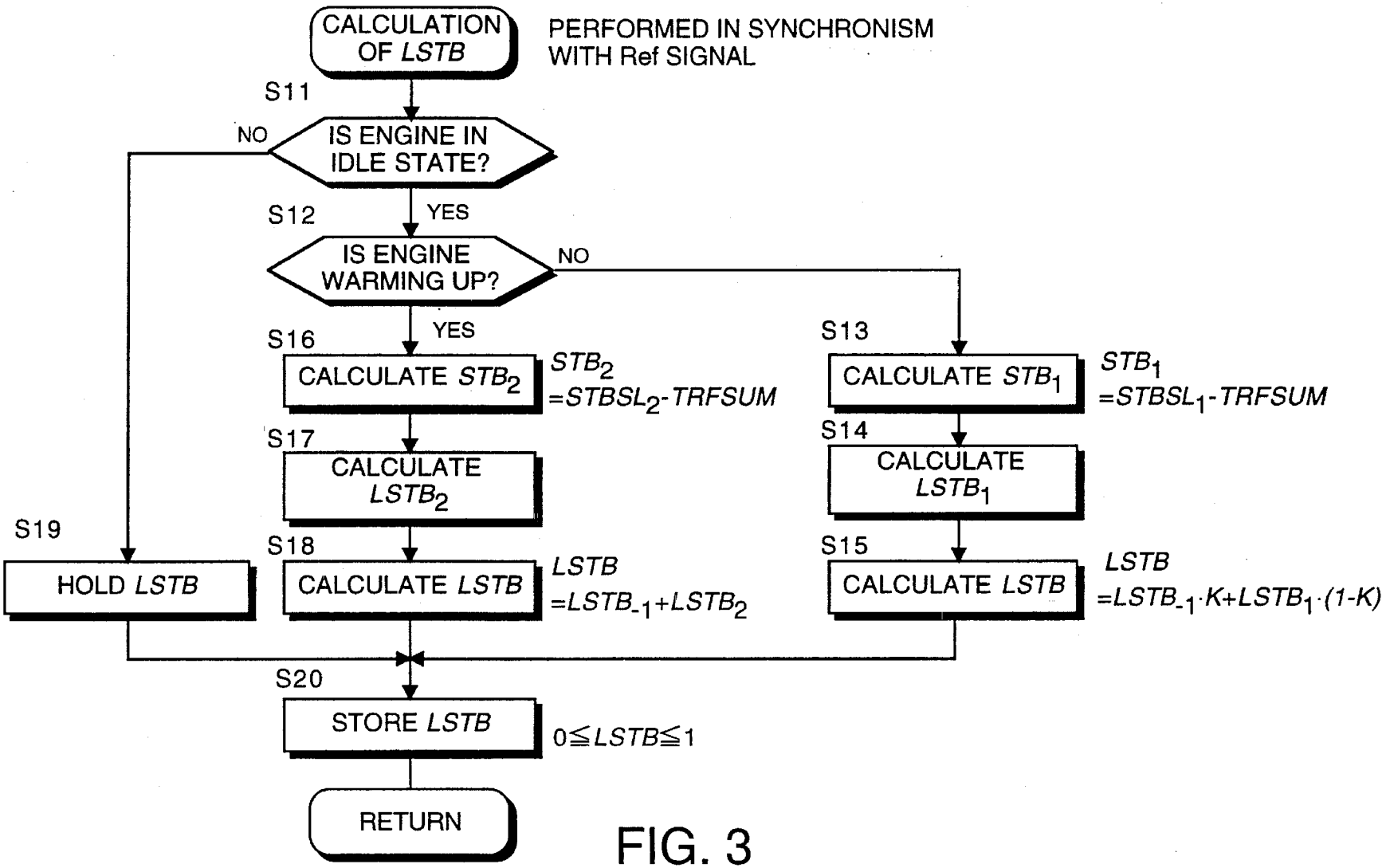
FIG. 3 is a flowchart describing a process for computing a stability indicator learning value LSTB according to this invention.

Next, a learning value LSTB of a stability indicator is computed according to a flowchart of FIG. 3 based on the computed engine stability indicator TRFSUM. The routine of FIG. 3 is also performed in synchronism with the Ref signal.

In a step S11, it is determined from a throttle opening TVO and an engine speed N whether or not the engine is idle. Herein, a precondition for performing the learning computation is that the engine be idle. If the engine is not idle, learning is not performed, the learning value LSTB of the stability indicator is hold without modification in a step S19, the learning value LSTB is stored in a RAM in a step S20 and the routine is terminated.

When the engine is idle, the routine proceeds to a step S12, and it is determined from the engine cooling water temperature TW whether or not the engine is warming up. If warm-up has been completed, the routine proceeds to a step S13. In the step S13, a difference between an engine speed variation tolerance slice level $STBSL_1$ after warm-up obtained for the heaviest fuel and the stability indicator TRFSUM, is calculated as a stability tolerance factor $STB_1$.

Figure 4:
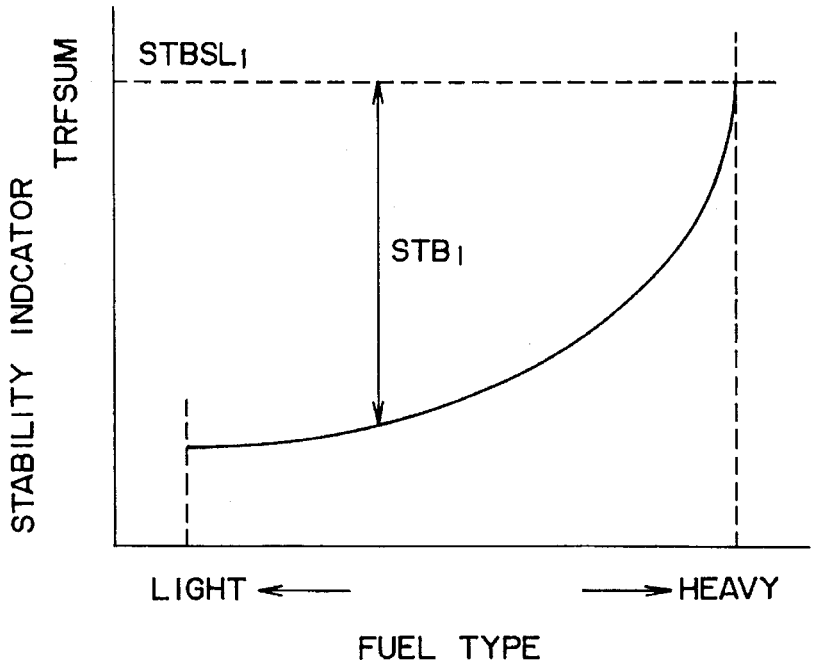
FIG. 4 is a diagram showing characteristics of a stability indicator TRFSUM after warm-up according to this invention.
Figure 5:
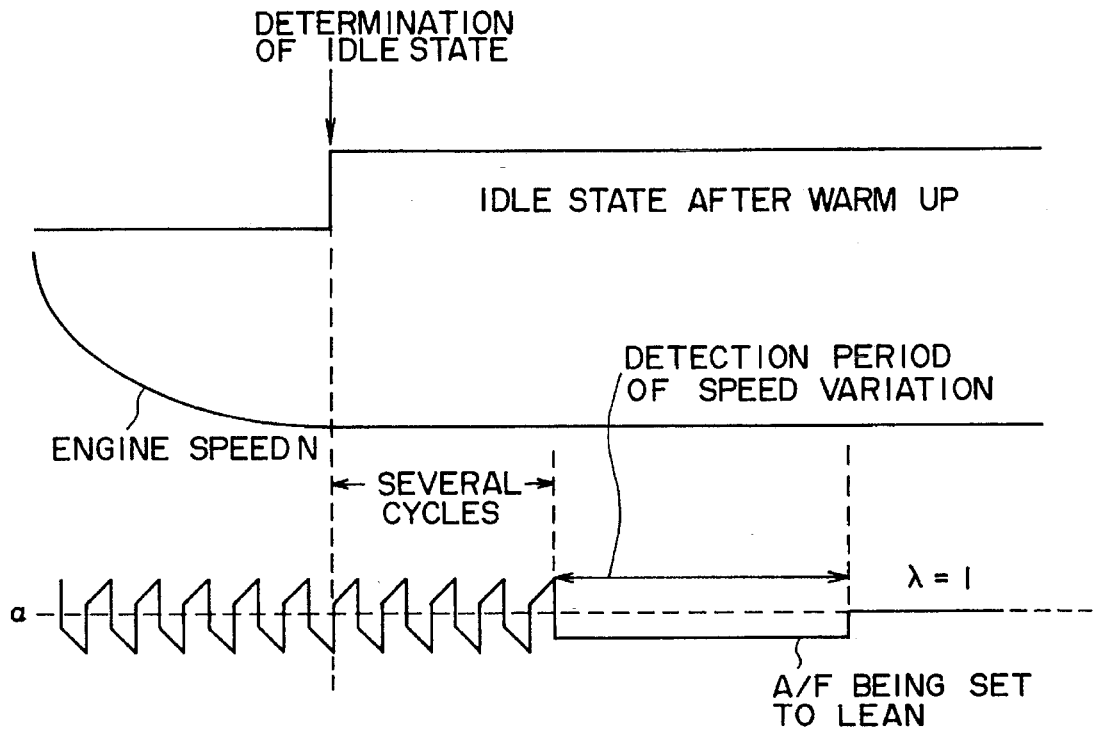
FIG. 5 is a diagram showing a speed variation detection interval during an idle period after warm-up according to this invention.

The engine stability varies as shown in FIG. 4 depending on differences in fuel type, and in general, a large value is obtained for the stability tolerance factor $STB_1$ when light fuel is used. Such a clear difference may not however emerge in the idle state after warm-up is complete, so the interval during which engine speed variation is detected is set as shown in FIG. 5. In other words, air-fuel ratio feedback control is performed for a plurality of cycles from the time when it is determined that the engine is idle, and an air-fuel ratio feedback correction coefficient $\alpha$ is fixed such that the air-fuel ratio is slightly leaner than the theoretical air-fuel ratio shown by a line $\lambda=1$ in the figure for a predetermined period. The engine speed variation is detected during this interval. The reason why engine speed variation is detected when the air-fuel ratio is lean is that when it is lean, fuel properties have a major impact on engine speed variation and the value of $STB_1$ is large.

In the idle state after warm-up is complete, the air-fuel ratio and fuel properties have the same effect on stability of engine speed for engines having the same specification. It is however expedient to first find, by means of experiment, an air-fuel ratio at which the effect of fuel properties tends to appear easily in the idle state after warm-up is complete, and to set this as the lean air-fuel ratio for the engine speed variation detection interval.

Figure 6:
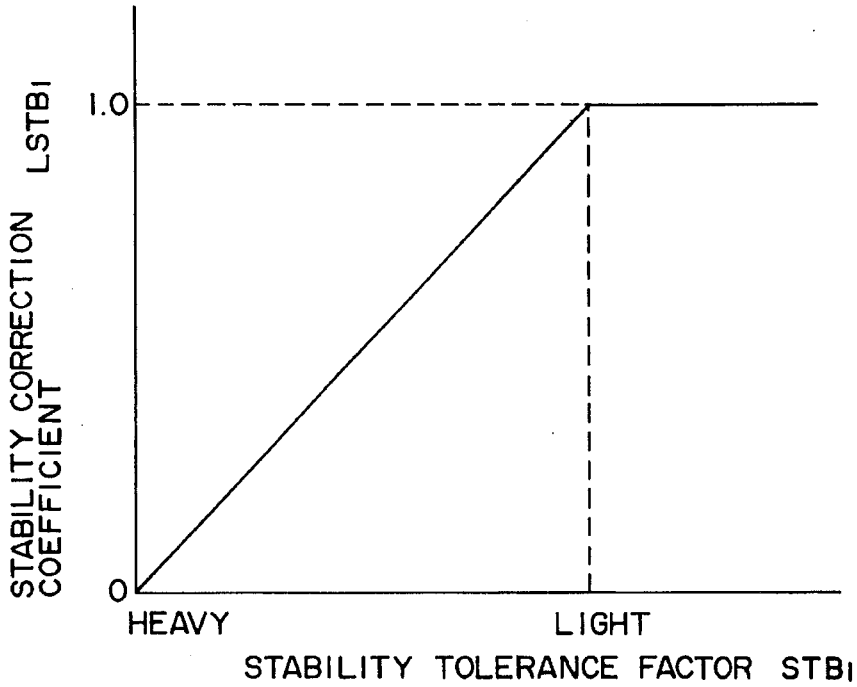
FIG. 6 is a diagram showing characteristics of a stability correction coefficient $LSTB_1$ according to this invention.

A stability correction coefficient $LSTB_1$ is found from a map shown in FIG. 6 in a step S14 according to the value of the stability tolerance factor $STB_1$. It is assumed that $LSTB_1$ varies such that the stability tolerance factor $STB_1$ is 0 for the heaviest fuel, 1 for the lightest fuel, and that it varies linearly between these two limits as shown in FIG. 6.

A weighted average is found for the stability correction coefficient $LSTB_1$ by the following equation in a step S15 in FIG. 3, and the learning value LSTB of the stability indicator is found.

$$LSTB=K\cdot LSTB_{-1}+(1-K)\cdot LSTB_1 \quad (3)$$

where, $LSTB_{-1}$ is value of LSTB on immediately preceding occasion, and

K is weighting average coefficient.

The value obtained is stored in a RAM in a step S20, and the routine of FIG. 3 is terminated. In the step S20, the value of the stored learning value LSTB is limited to the range $0 \leqq LSTB \leqq 1$. The weighting average coefficient K of equation (3) is found considering the stability of the learning value LSTB in the idle state after warm-up is complete, and its following capacity when fuel properties change.

In the step S12, when warm-up is not complete, the routine proceeds to a step S16, where the difference between an engine speed variation tolerance slice level $STBSL_2$ before warm-up is complete and TRFSUM is calculated as a stability tolerance factor $STB_2$.

Figure 7:
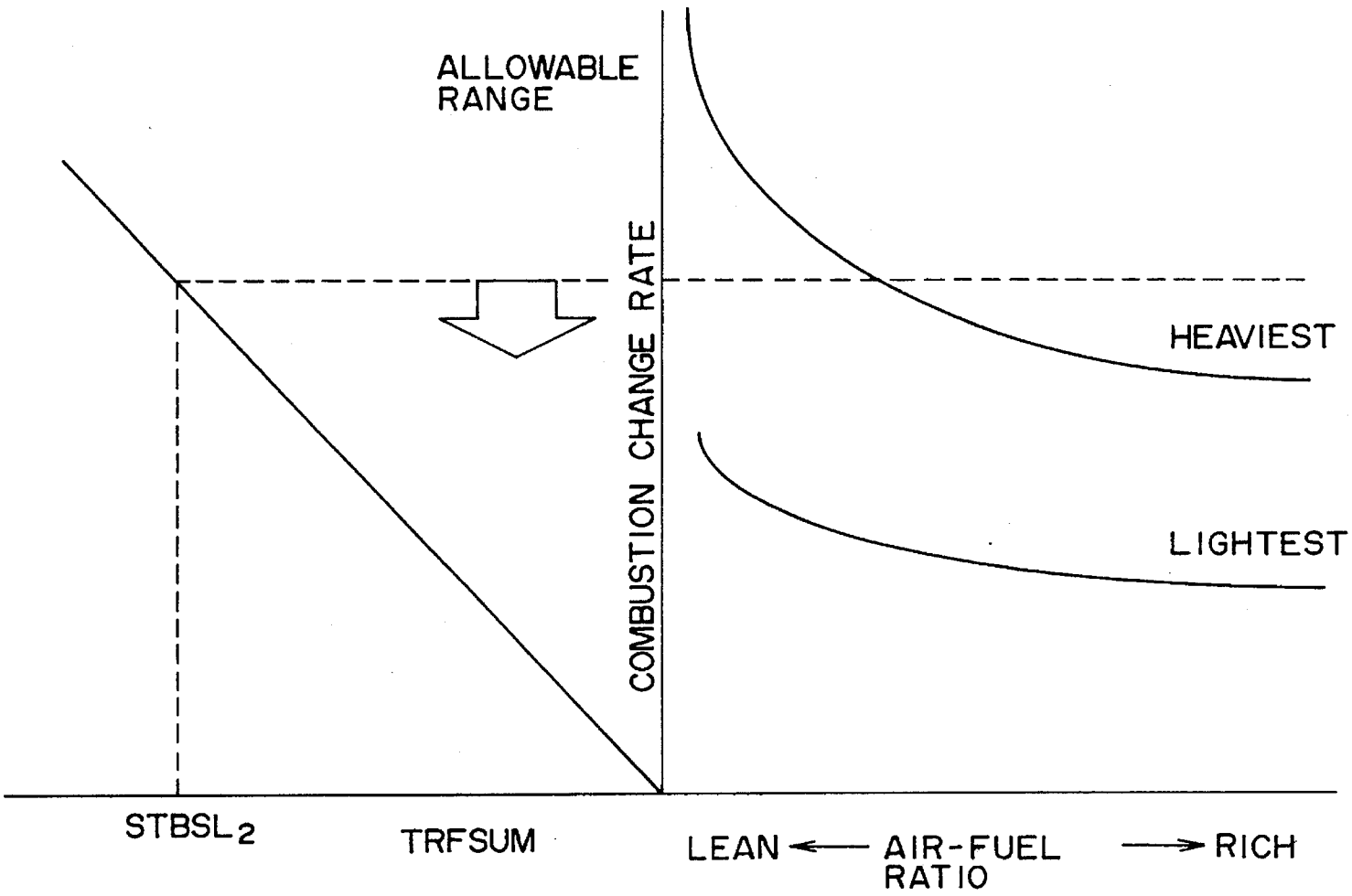
FIG. 7 is a diagram showing a relation between air-fuel ratios for heavy fuel and light fuel, a combustion variation rate and a speed variation before warmup, according to this invention.

In the idle state before warm-up is complete, engine stability varies more due to fuel properties and aft-fuel ratio than in the idle state after warm-up is complete. The correlation between the air-fuel ratio, combustion change rate and speed variation is therefore first found by experiment for the heaviest and lightest fuels for example, as shown in FIG. 7, and the tolerance slice level $STBSL_2$ of the corresponding engine speed variation is set from the tolerance limits for the combustion change when the heaviest fuel is used. From this figure, the air-fuel ratio to obtain the slice level $STBSL_2$ using the heaviest fuel and the air-fuel ratio to obtain the slice level $STBSL_2$ using the lightest fuel, can be found.

After calculating the stability tolerance factor $STB_2$ before warmup is complete, a stability correction coefficient $LSTB_2$ before warm-up is complete is computed in a step S17. In order to feed back this stability correction coefficient $LSTB_2$ to the learning value LSTB, the learning value LSTB is updated by the following equation in a step S18.

$$LSTB=LSTB_{-1}+LSTB_2 \quad (4)$$

The reason for feeding the stability correction coefficient back to the learning value LSTB is as follows.

If the learning value LSTB was suitably determined in the idle state after warm-up is complete on the immediately preceding occasion when the engine was running, and the fuel properties have not changed from the immediately preceding occasion, TRFSUM before warm-up is complete on the present occasion should be in the vicinity of the slice level $STBSL_2$.

However, the learning value may shift after warm-up from what it was before warm-up, and fuel properties may suddenly change after the learning process has been completed, so the stability correction coefficient $LSTB_2$ is found as a feedback correction mount to allow for this possibility.

Figure 8:
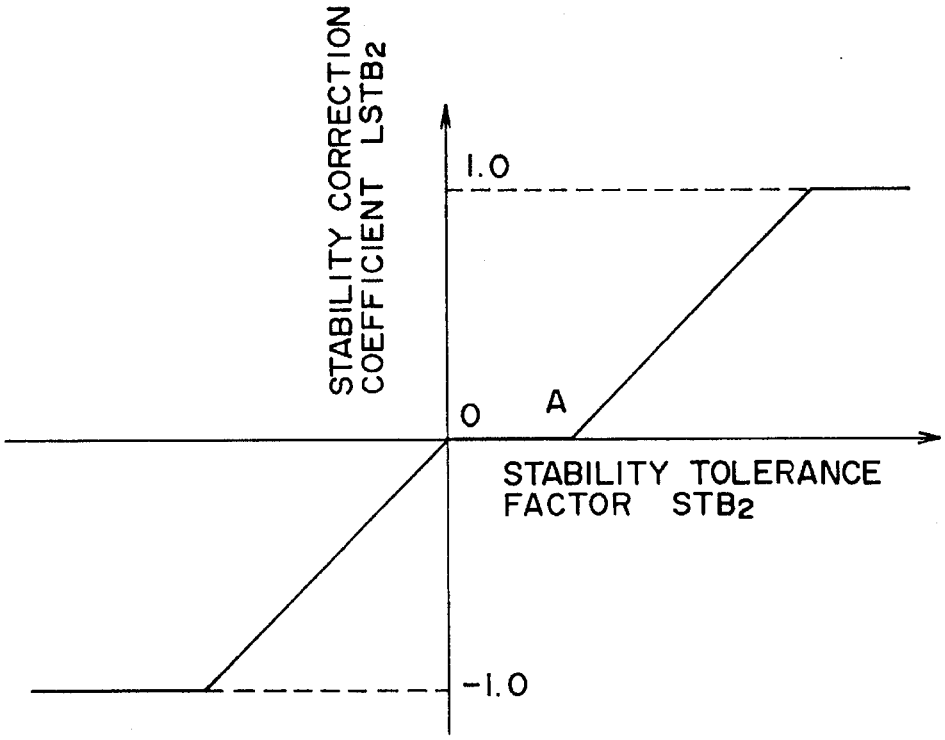
FIG. 8 is a diagram showing characteristics of a stability correction coefficient $LSTB_2$ according to this invention.

$LSTB_2$ is a value from −1 to 1 as shown in FIG. 8. When $STB_2$ is positive there is some tolerance in stability, so $LSTB_2$ is increased in proportion to $STB_2$ and the learning value LSTB is modified to a greater amount accordingly.

Conversely when $STB_2$ is negative the vehicle is unstable, so $LSTB_2$ is also set to a negative value and the learning value LSTB is modified to a lesser amount accordingly. The learning value LSTB is further stabilized by providing a dead zone where LSTB=0 when $STB_2$ is a small positive value (when there is a small tolerance in stability).

The learning value LSTB of the stability indicator computed in this manner is stored in a RAM, and used for a warm-up correction and transient correction of fuel injection amount described hereinbelow.

Figure 9:
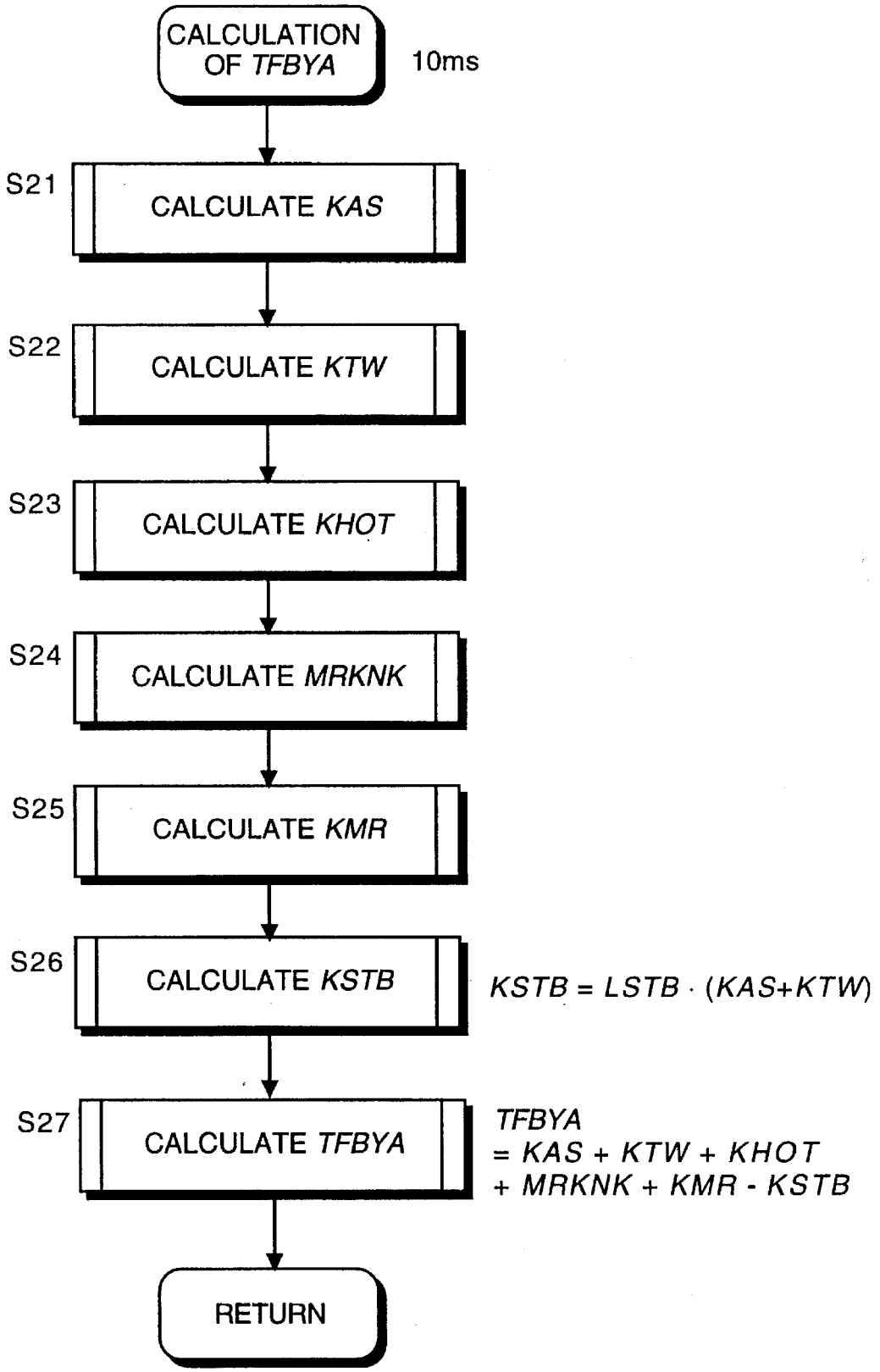
FIG. 9 is a flowchart describing a process for computing a target air-fuel ratio TFBYA according to this invention.

FIG. 9 is a flowchart describing the process of computing a target air-fuel ratio TFBYA.

This process is executed at a fixed interval of, e.g. 10 ms.

From the step S21 to the step S25, in addition to the post-warmup correction coefficient KAS and the water temperature correction coefficient KTW, a correction coefficient KHOT for high water temperature, together with a correction coefficient MRKNK when knock control is retarded and a mixing assignment correction coefficient KMR, is computed. These coefficients are computed as described for example in the aforesaid prior art.

The correction coefficient KAS decreases at a fixed rate together with the elapsed time after startup is completed, from an initial value determined depending on the cooling water temperature TW, and finally becomes 0. The water temperature correction coefficient KTW is a value dependent on the cooling water temperature, both KAS and KTW being initially set for the heaviest fuel as described hereinabove.

In a step S26, the learning value LSTB is read from the RAM, and the correction coefficients KAS, KTW are modified as follows according to this learning value LSTB.

$$KSTB=LSTB\cdot(KAS+KTW) \quad (5)$$

The modified value is a stability correction coefficient KSTB. In a step S27, the target air-fuel ratio TFBYA is calculated from the aforesaid correction coefficients by the following equation, and the routine is terminated.

$$TFBYA=KAS+KTW+KHOT+MRKNK+KRM-KSTB \quad (6)$$

The above equation denotes that the post-startup correction coefficient KAS and the water temperature correction coefficient KTW air modified as follows:

Post-startup correction coefficient according to this invention:

$$KAS(1-LSTS) \quad (7)$$

Water temperature correction coefficient according to this invention:

$$KTW(1-LSTB) \quad (8)$$

According to this invention, as KAS, KTW were initialized for the heaviest fuel, these coefficients are decreased by the learning value LSTB.

The learning value LSTB is initialized to 0, and in the initial setting, the post-startup correction coefficient and water temperature correction coefficient are both values for the heaviest fuel from equations (7), (8).

When the lightest fuel is used, therefore, the learning value LSTB is 0 on the first start-up and the vehicle is driven with a rich air-fuel ratio when it is warming up. However, the learning value LSTB is calculated from the flowchart of FIG. 3, and the post-startup correction coefficient and water temperature correction coefficient previously reduced by this learning value LSTB are used for the next start-up. Hence, compared to the conventional control where the determination of fuel properties is cleared when the vehicle stops and fuel properties have to be freshly determined on each start-up, an air-fuel ratio suited to fuel properties can be obtained at an earlier stage.

Figure 10:
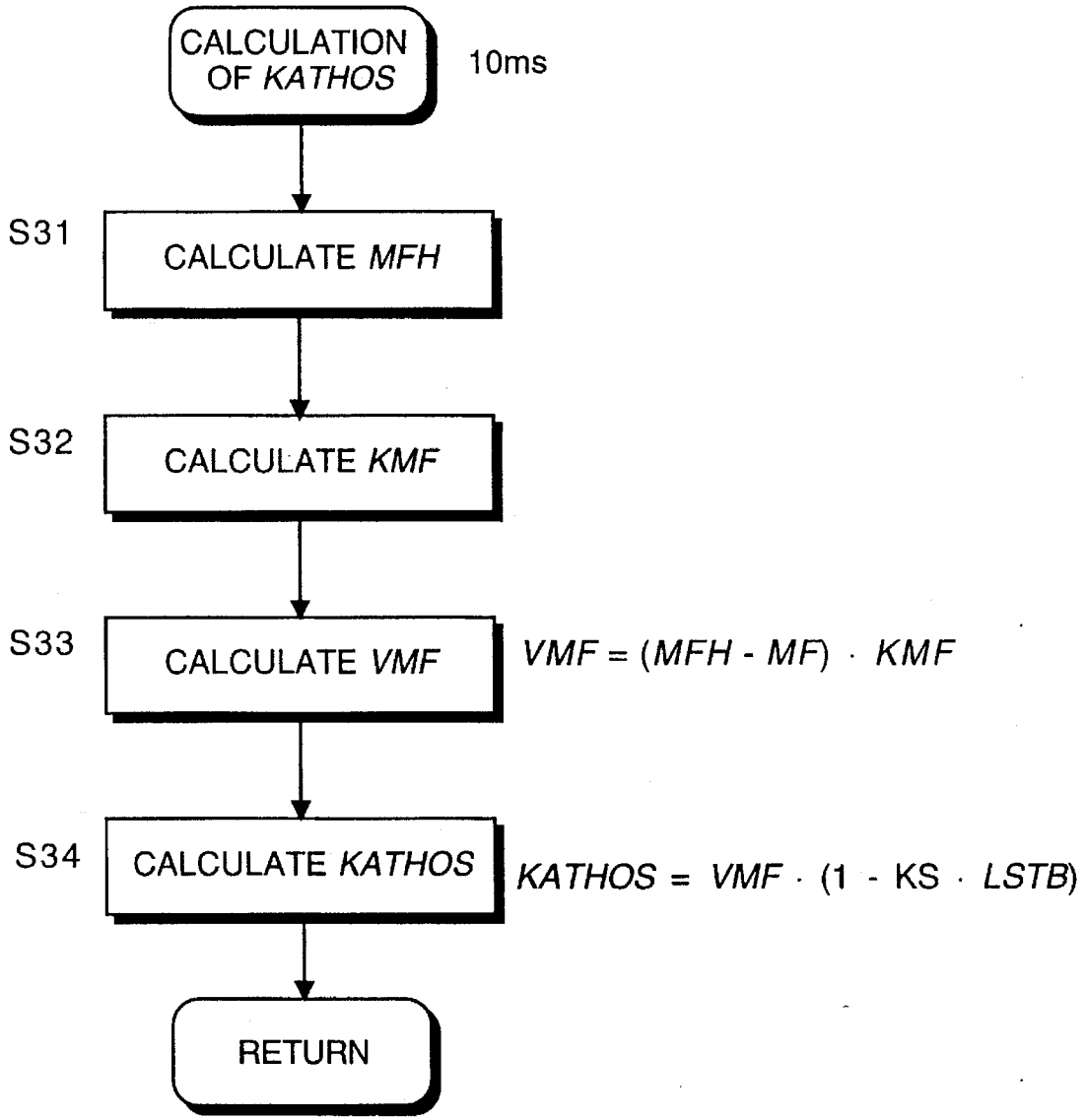
FIG. 10 is a flowchart describing a process for computing a transient correction KATHOS according to this invention.

The flowchart of FIG. 10 shows a process for computing a transient correction KATHOS. According to this invention, a learning value similar to the post-warmup correction coefficient and water temperature correction coefficient can also be applied to the transient correction KATHOS.

This computation process is disclosed for example in U.S. Pat. No. 5,265,581. The method of calculating a steady state fuel wall deposition amount MFH, deposition variation rate KMF and deposition rate VMF in steps S31–S33 is also described in detail in for example Tokkai Sho 62-159741 published by the Japanese Patent Office in 1987. The description here will therefore be limited to those parts relevant to the features of this invention.

According to this invention, the equation applied in a step S34 is different from the aforesaid prior art.

In the step S4 of FIG. 10, the aforementioned learning value LSTB is read from the RAM, and the transient correction KATHOS is calculated by the following equation using this read value of LSTB.

$$KATHOS=VMF\cdot(1-KS\cdot LSTB) \quad (9)$$

where, KS is a matching coefficient

According to this invention, initial values corresponding to the heaviest fuel are set also for MFH and KMF, and VMF·LSTB·KS is decreased by equation (9). The matching coefficient is a constant determined experimentally.

In this case too, the learning value LSTB is initialized to 0, so in the initial setting, the transient correction found by equation (9) is a value for the heaviest fuel.

When light fuel is used, therefore, the learning value LSTB is 0 when the vehicle first starts and transient operations such as acceleration and deceleration during warmup are performed with a rich air-fuel ratio, however the learning value LSTB is calculated according to the flowchart of FIG. 3, and the next occasion the vehicle starts, a transient correction KATHOS decreased by this learning value LSTB is applied. A transient air-fuel ratio suited to fuel properties can therefore be obtained at an early stage.

Figure 11:
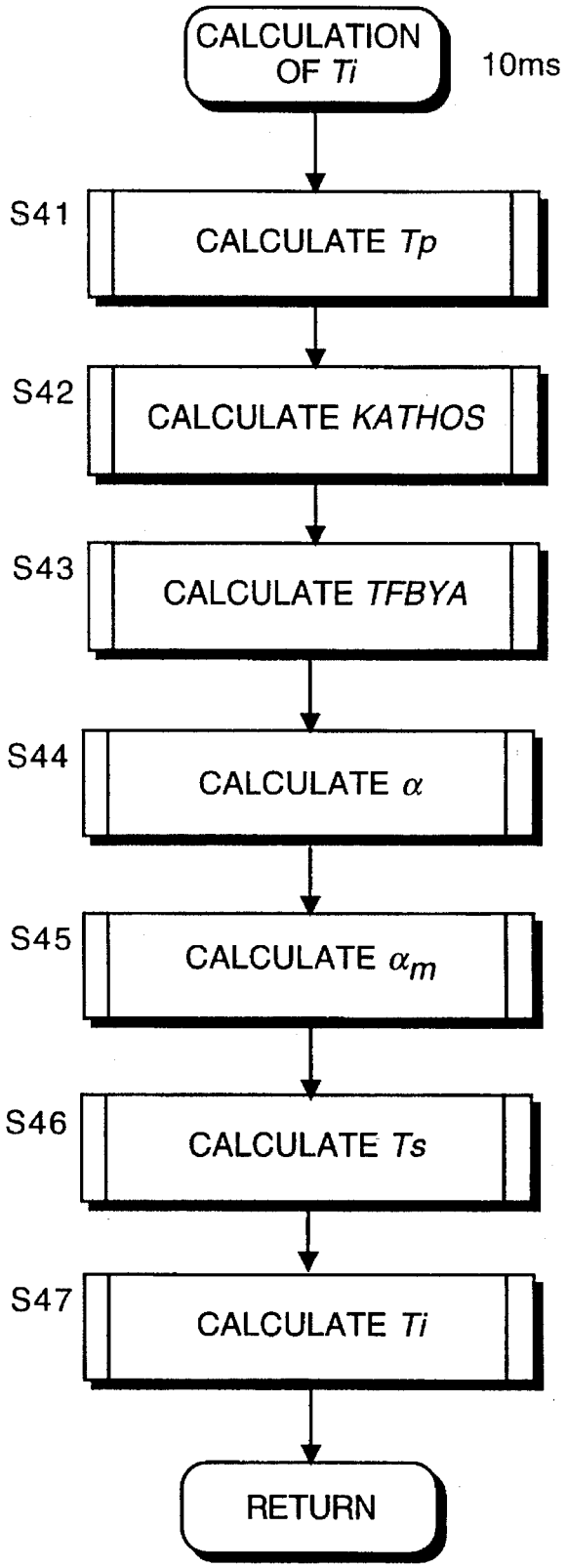
FIG. 11 is a flowchart describing a process for computing a fuel injection pulse width Ti according to this invention.

The flowchart of FIG. 11 shows the process of computing a fuel injection pulse width Ti.

In a step S41, a basic injection pulse width Tp obtained from a predetermined air-fuel ratio is calculated by the equation $$TP=\frac{k\cdot Q}{N}$$

using an intake air volume Q and engine speed N. R is a constant.

In a step S42, the transient correction KATHOS is computed, and in a step S43, the target air-fuel ratio TFBYA is computed. The process of computing KATHOS is performed according to the flowchart of FIG. 10, and the computation of TFBYA is performed according to the flowchart of FIG. 9.

In a step S44, an air-fuel ratio feedback correction coefficient α based on the signal from an oxygen sensor, in a step S45, an air-fuel ratio correction learning value am and in a step S46, a correction Ts for correcting an opening delay of the fuel injection valve due to voltage drop, are respectively calculated. These calculations are performed as described in U.S. Pat. No. 5,265,581.

In a step S47, the fuel injection pulse width Ti is calculated using these values and the aforesaid Tp, KATHOS and TFBYA, and the routine of FIG. 11 is terminated.

$$Ti=(Tp+KATHOS)\cdot TFBYA\cdot(\alpha+\alpha m-1)+Ts$$

Figure 12:
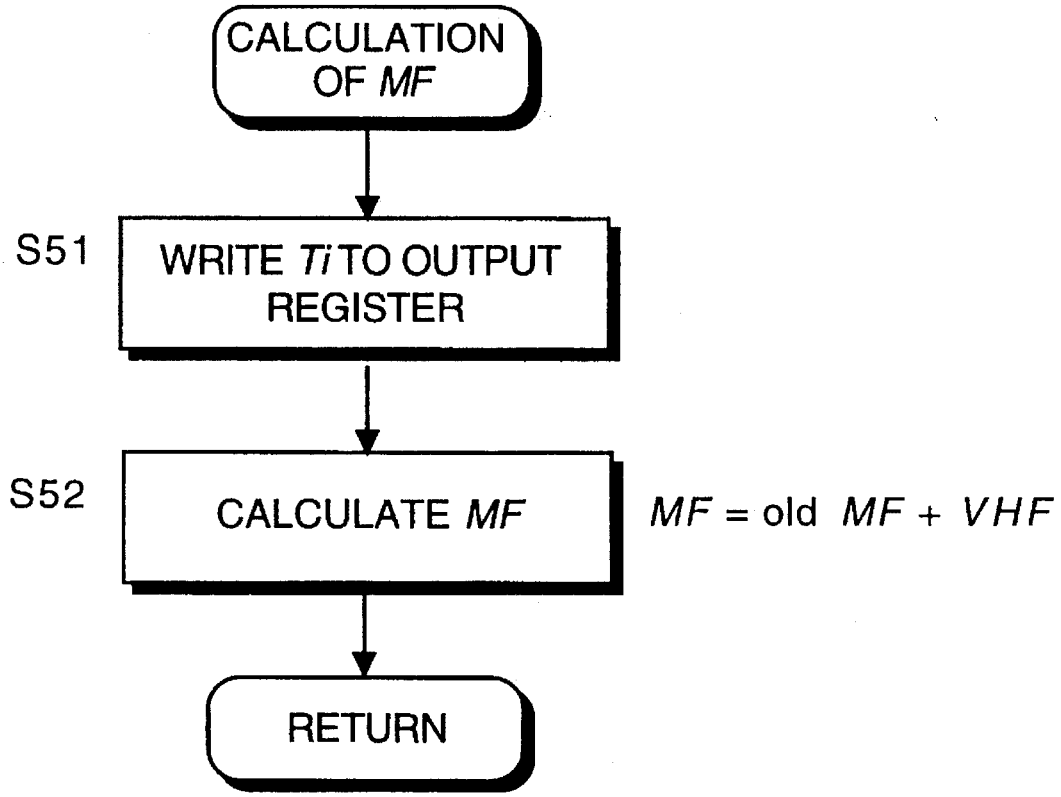
FIG. 12 is a flowchart describing a process for computing a fuel deposition amount MF according to this invention.

The flowchart of FIG. 12 shows the process of fuel injection. Herein, the control unit 2 uses a value for the fuel injection pulse width Ti calculated in the flowchart of FIG. 11. In a step S51, this value is written to a built-in output resistor, and when a predetermined injection timing arrives, a drive signal according to Ti is output to the fuel injection valve 7.

Using this injection timing, a predicted deposition mount MF used in the step S33 of FIG. 11 is updated. This is done by adding a variation rate VMF computed on this occasion, to the immediately preceding prediction amount MF (old MF). As the injection timing is determined in synchronism with the Ref signal, injection is performed for example every one rotation of the crankshaft. The processing of FIG. 1 is also synchronized with the Ref signal, and the prediction mount MF is updated on every injection.

The aforesaid air-fuel ratio control will now be described with reference to FIGS. 13A–13C and FIGS. 14A–14C. In these figures, the expression heavy fuel means fuel which is slightly lighter than the heaviest fuel, and the expression light fuel means fuel which is slightly heavier than the lightest fuel.

Before learning, the values of KAS, KTW are set for the heaviest fuel. If light fuel is used in this state, therefore, the air-fuel ratio is largely shifted to rich and fuel is needlessly consumed as shown by the dotted line of FIG. 13A due to fuel oversupply.

Subsequently, an engine speed variation is detected during a predetermined speed variation detection interval each time the engine enters an idle state after warmup. When light fuel is used, the stability indicator TRFSUM becomes smaller and the stability tolerance factor $STB_1$ increases, so the calculated stability correction coefficient $LSTB_1$ is a large positive value.

The learning value LSTB is computed using a weighted average of this stability correction coefficient $LSTB_1$. Due to learning, the learning value LSTB is a value larger than 0 and less than 1.

This learning value LSTB is stored in the RAM even after the engine stops, and on the next startup, warmup correction begins using KAS and KTW decreased by the learning value LSTB found from equations (7), (8).

If LSTB is 0.7 for example and KS is 1, KAS and KTW are decreased to 30% of their values for the heaviest fuel. As LSTB is a learning value, KAS and KTW are decreased immediately after startup, and an air-fuel ratio suited to light fuel is therefore obtained as shown by the solid line in FIG. 13A while stability is maintained during the period from immediately after startup to completion of warmup.

In other words, even if fuel of different properties is used, a suitable air-fuel ratio is set immediately after startup excepting for the first startup, and the amount of emission immediately after startup is suppressed.

Further, according to this invention, the detection interval for the stability indicator TRFSUM in the idle state after warmup is taken as a predetermined interval when the air-fuel ratio is slightly leaner than the stoichiometric air-fuel ratio after several air-fuel ratio feedback control cycles have been performed after the idle state has been determined to have started. Hence, even in an engine wherein engine speed variations are not prominent during the idle period after warmup, variations can be detected exactly and the reliability of the stability indicator TRFSUM is increased.

The learning value LSTB is learned from post-warmup engine speed variations, but if the value of LSTB is appropriate, TRFSUM approaches $STBSL_2$ even in the idle state before warmup is complete.

Figure 13A:
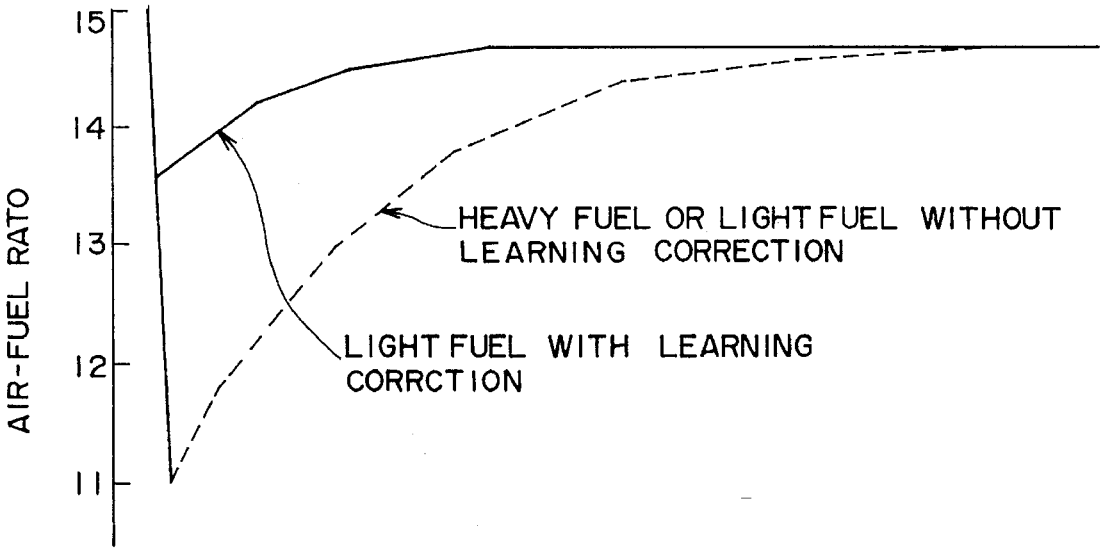
FIGS. 13A, 13B, 13C comprise one diagram showing an air-fuel ratio variation, engine speed variation TRFSUM and stability indicator LSTB during startup according to this invention.
Figure 13B:
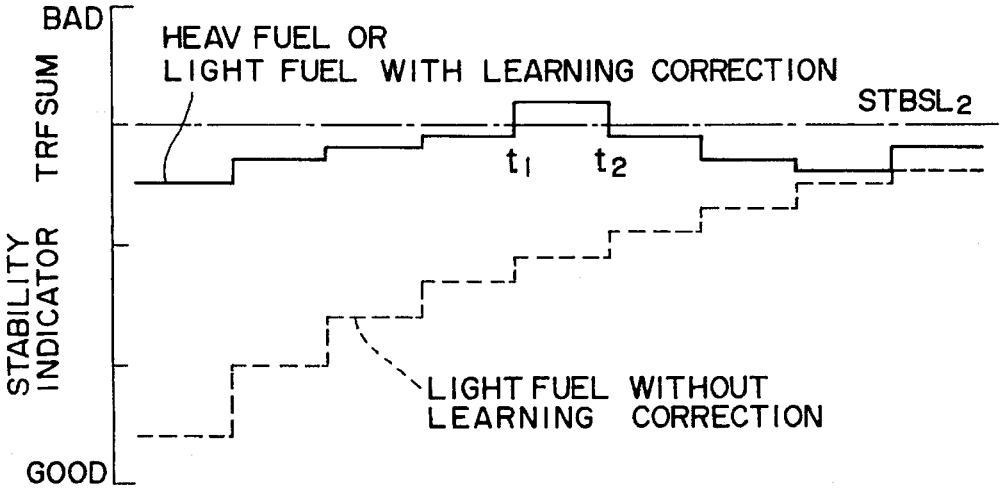
Figure 13C:
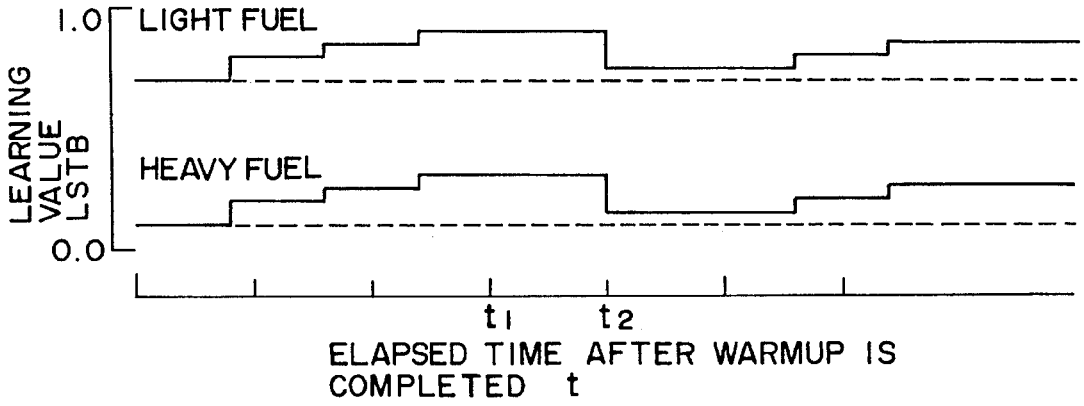

However, when there is an inconsistency between the air-fuel ratio corrected by the learning value LSTB and a preferred air-fuel ratio based on actual fuel properties, TRFSUM may exceed $STBSL_2$, for example as shown by the interval from $t_1$ to $t_2$ on the solid line in FIG. 13B.

In such a case, the stability tolerance factor $STBSL_2$ is a negative value. The stability correction coefficient $LSTB_2$ is therefore also a negative value, and the learning value LSTB is updated to a smaller value than on the immediately preceding occasion at a time $t_2$ on the solid line indicating light fuel in FIG. 13C. Due to this updating of the learning value LSTB to this reduced value, KTW and KAS are increased, and TRFSUM returns to the vicinity of $STBSL_2$ as shown by the line after $t_2$ in FIG. 13B.

When the learning value LSTB is a value corresponding to light fuel and heavy fuel is supplied before the present startup, if a warmup correction were applied during startup by correcting KAS and KTW using the stored learning value, fuel would be in undersupply, and TRFSUM would largely exceed $STBSL_2$ in the idle state before warmup is complete. However according to this invention, in this case, the stability tolerance factor $STBSL_2$ is a negative value, and as the stability correction coefficient $LSTB_2$ is therefore also a negative value, the learning value LSTB is updated to a smaller value. KTW and KAS are therefore increased, and TRFSUM returns to the vicinity of the slice level $STBSL_2$.

Likewise, when the learning value LSTB is a value corresponding to heavy fuel and light fuel is supplied before the present startup, fuel would be in oversupply, and TRFSUM would be much less than $STBSL_2$ in the idle state before warmup. In such a case, if the stability tolerance factor $STBSL_2$ is a positive value greater than A in FIG. 8, the stability correction coefficient $LSTB_2$ will also be a positive value. The learning value LSTB is therefore updated to a larger value, and KTW, KAS are decreased by this learning value. TRFSUM therefore increases, and returns to the vicinity of the slice level $STBSL_2$.

In the idle state before warmup is complete, the difference between the engine speed variation tolerance slice level $STBSL_2$ corresponding to the heaviest fuel and TRFSUM is calculated as a stability tolerance factor $STB_2$, and the stability correction coefficient $LSTB_2$ computed from $STB_2$ is fed back to the correction of the learning value LSTB. Hence, even when there are shifts of learning values learned after warmup is complete, or when there is a sudden change of fuel properties after learning on the immediately preceding occasion has been completed, engine speed variations can be controlled closely within stable limits.

Figure 14A:
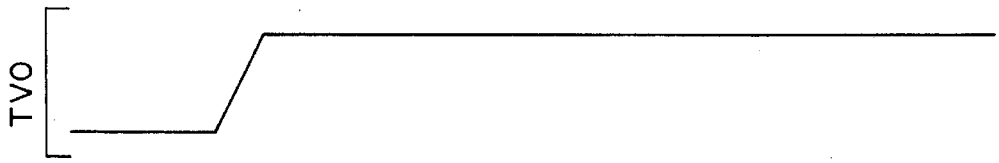
FIGS. 14A, 14B, 14C comprise one diagram showing variations of a throttle opening TVO, a transient correction coefficient KATHOS and the air-fuel ratio according to this invention.
Figure 14B:
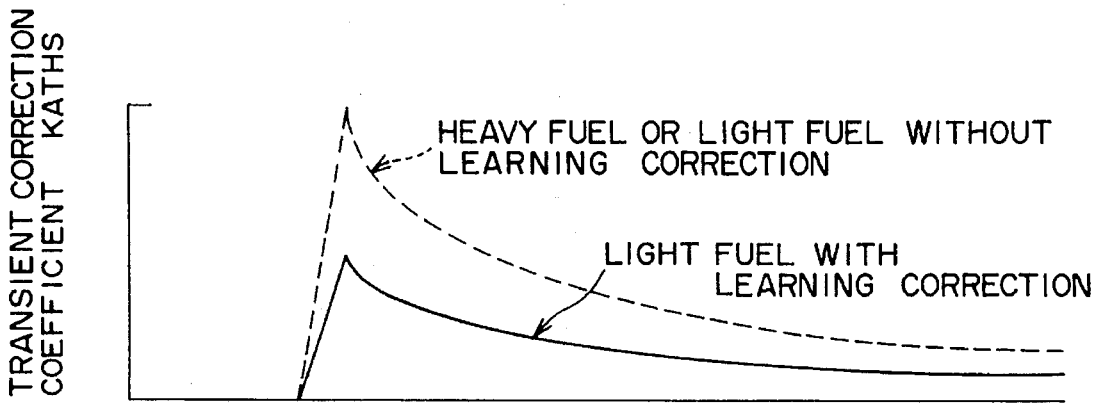
Figure 14C:
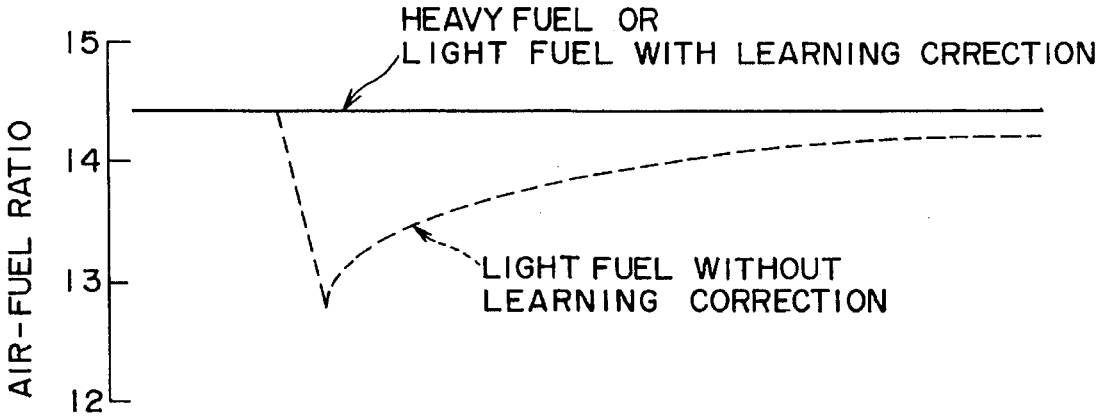

FIG. 14A–14C show a situation when the vehicle accelerates after warmup is complete.

According to this invention, the steady state fuel deposition amount MFH and deposition variation rate KMF are initialized for the heaviest fuel, hence when light fuel is used for acceleration before learning, the transient correction coefficient KATHOS becomes excessive, and the air-fuel ratio shifts to rich as shown by the dotted lines in FIG. 14B and 14C.

However, as learning progresses with light fuel as described hereinabove, the learning value LSTB approaches 1.0, and the transient correction coefficient KATHOS is reduced by the learning value LSTB of equation (9) to a lower setting than its initial value as shown by the solid line of FIG. 14B. In other words, a transient correction coefficient KATHOS suited to light fuel is applied due to learning, the air-fuel ratio during acceleration does not shift to rich, and a suitable value is maintained as shown by the solid line of FIG. 14C.

Likewise, when light fuel is used for deceleration before learning, the transient correction coefficient KATHOS becomes insufficient and a lean error occurs in the air-fuel ratio, however it .will be understood that after learning is performed, the air-fuel ratio during deceleration does not shift to lean.

According to the aforesaid embodiment, the weighted average of the stability correction coefficient $LSTB_1$ was calculated as the learning value LSTB in order to consider the stability of the learning value, however a simple average of $LSTB_1$ may also be taken as the learning value LSTB.

Accordingly, although the present invention has been shown and described in terms of the preferred embodiment thereof, it is not to be considered as limited by any of the perhaps quite fortuitous details of said embodiment, or of the drawings, but only by the terms of the appended claims, which follow.

We claim:

1. A device for controlling a air-fuel ratio of an air-fuel mixture supplied to an engine during warmup, comprising:

means for initializing a warmup fuel amount corresponding to a predetermined heavy fuel, means for detecting an engine speed variation, means for determining whether or not said warmup has been completed, means for computing a difference between a post-warmup engine speed variation and a first reference value as a post-warmup stability tolerance factor, means for computing a stability indicator learning value based on said post-warmup stability tolerance factor, means for storing said learning value after the engine has stopped, means for decreasing said warmup fuel amount to a decreased warmup mount based on said learning value when the engine is restarted, and means for supplying said decreased warmup fuel amount to the engine.

2. An air-fuel ratio controller as defined in claim 1, wherein said learning value computing means comprises means for computing a stability correction coefficient which increases the lighter the fuel based on said stability tolerance factor, and means for obtaining said learning value by calculating a weighted average of said stability correction coefficient.

3. An air-fuel ratio controller as defined in claim 1, further comprising means for computing a difference between an engine speed variation before warmup is complete and a second reference value as a pre-warmup stability tolerance factor, and means for correcting said learning value according to said pre-warmup stability tolerance factor.

4. An air-fuel ratio controller as defined in claim 1, wherein said controller further comprises means for detecting whether or not the engine is in an idle state, and said engine speed variation detecting means detects said engine speed variation only in the case when the engine is in said idle state.

5. An air-fuel ratio controller as defined in claim 4, wherein said controller further comprises:

means for detecting said air-fuel ratio, means for feedback controlling said supply means such that a detected air-fuel ratio approaches a preset target air-fuel ratio, and means for controlling said supply means such that said air-fuel ratio is slightly leaner than a stoichiometric air-fuel ratio when said feedback control means has performed several feedback control cycles after the engine is detected to be in said idle state, and wherein said engine speed variation detecting means detects said engine speed variation when said air-fuel ratio is slightly leaner than the stoichiometric air-fuel ratio in said idle state.

6. An air-fuel ratio controller as defined in claim 1, further comprising:

means for initializing a transient fuel amount corresponding to a predetermined heavy fuel, means for decreasing said transient fuel amount to a decreased transient amount based on said stored learning value, and means for increasing said decreased warmup amount based on said decreased transient amount.

* * * * *